US008286755B2

(12) United States Patent
Eto et al.

(10) Patent No.: US 8,286,755 B2
(45) Date of Patent: Oct. 16, 2012

(54) GROUP MANAGEMENT CONTROLLER OF ELEVATOR INCLUDING LIMIT VALUE SETTING MEANS FOR SETTING A LIMIT VALUE FOR LIMITING A COUNT OF CAR CALLS

(75) Inventors: Masaharu Eto, Aichi (JP); Shiro Hikita, Tokyo (JP)

(73) Assignee: Mitsubishi Elelctric Corporation, Tokyo (JP)

( * ) Notice: Subject to any disclaimer, the term of this patent is extended or adjusted under 35 U.S.C. 154(b) by 427 days.

(21) Appl. No.: 12/599,895

(22) PCT Filed: May 23, 2007

(86) PCT No.: PCT/JP2007/060515

§ 371 (c)(1),
(2), (4) Date: Nov. 12, 2009

(87) PCT Pub. No.: WO2008/142785

PCT Pub. Date: Nov. 27, 2008

(65) Prior Publication Data

US 2010/0300814 A1 Dec. 2, 2010

(51) Int. Cl.
*B66B 1/16* (2006.01)

(52) U.S. Cl. ..... 187/381; 187/391

(58) Field of Classification Search ..... 187/247, 187/380–389, 391–393, 396
See application file for complete search history.

(56) References Cited

U.S. PATENT DOCUMENTS

| | | | | |
|---|---|---|---|---|
| 3,561,571 | A * | 2/1971 | Gingrich | 187/387 |
| 3,739,880 | A * | 6/1973 | Robaszkiewicz | 187/387 |
| 3,750,850 | A * | 8/1973 | Winkler et al. | 187/389 |
| 3,815,712 | A * | 6/1974 | Walton | 187/387 |
| 3,973,649 | A * | 8/1976 | Iwasaka et al. | 187/387 |
| 3,999,631 | A * | 12/1976 | Iwasaka et al. | 187/387 |
| 4,046,227 | A * | 9/1977 | Kirsch et al. | 187/387 |

(Continued)

FOREIGN PATENT DOCUMENTS

JP 59 190171 10/1984

(Continued)

OTHER PUBLICATIONS

Office Action issued Dec. 7, 2011 in Chinese Patent Application No. 200780053055.7.

*Primary Examiner* — Anthony Salata
(74) *Attorney, Agent, or Firm* — Oblon, Spivak, McClelland, Maier & Neustadt, L.L.P.

(57) ABSTRACT

In an elevator system floors each include: a hall registration device that places a plurality of car calls for moving a car to destination floors different from one another; and a display device that displays the car that has been assigned the plurality of car calls. A limit value setting mechanism sets, for each of the plurality of floors separately, a limit value for limiting a count of the plurality of car calls that can be assigned to the same car. A count-up mechanism obtains, when a new car call is made, a call count of each car by a given method, based on information about the plurality of car calls that have been assigned to the car. A candidate car selector compares the limit value set to a floor where the new car call is made and the call count of the each car, to thereby select, as a candidate car, the car to which the new car call can be assigned from among the cars.

9 Claims, 3 Drawing Sheets

U.S. PATENT DOCUMENTS

| | | | | |
|---|---|---|---|---|
| 4,111,284 | A * | 9/1978 | Winkler et al. | 187/380 |
| 4,691,808 | A | 9/1987 | Nowak et al. | |
| 4,838,384 | A * | 6/1989 | Thangavelu | 187/385 |
| 4,915,197 | A | 4/1990 | Schroder | |
| 7,083,027 | B2 * | 8/2006 | Siikonen et al. | 187/383 |
| 7,416,057 | B2 * | 8/2008 | Kostka | 187/382 |
| 7,987,947 | B2 * | 8/2011 | Christy et al. | 187/249 |
| 2010/0025163 | A1 * | 2/2010 | Amano | 187/382 |

FOREIGN PATENT DOCUMENTS

| | | | |
|---|---|---|---|
| JP | 63 218484 | | 9/1988 |
| JP | 1 203189 | | 8/1989 |
| JP | 04059581 | A * | 2/1992 |
| JP | 5 201630 | | 8/1993 |
| JP | 2000 272850 | | 10/2000 |
| WO | WO 2007/049342 | A1 | 5/2007 |

* cited by examiner

GROUP MANAGEMENT CONTROLLER OF ELEVATOR INCLUDING LIMIT VALUE SETTING MEANS FOR SETTING A LIMIT VALUE FOR LIMITING A COUNT OF CAR CALLS

TECHNICAL FIELD

The present invention relates to an elevator group supervisory control system which supervises a plurality of elevator units as a group.

BACKGROUND ART

There have been conventionally proposed elevators with a hall car destination registration device installed on a main floor where passengers crowd in order to improve the transportation efficiency at the time of heavy traffic. The hall car destination registration device is operated on the main floor to register car calls with respect to a plurality of cars. In this type of conventional elevator, zones different from one another are determined in advance to be associated with respective cars. Each zone contains a plurality of floors. When a car call is made, a car associated with a zone that contains the destination floor is assigned the call. In the case where the destination floor is contained in none of the zones, a zone in the vicinity of the destination floor is expanded to make a car respond to the call (see Patent Document 1).

DISCLOSURE OF THE INVENTION

Problem to be Solved by the Invention

However, because each car is associated with a separate zone, if car calls are concentrated in a specific zone, the transportation amount fluctuates from one car to another. This lowers the overall transportation efficiency of the elevator, which is the opposite effect to the intended.

The present invention has been made to solve the problem described above, and an object of the present invention is therefore to obtain an elevator group supervisory control system that can improve the transportation efficiency of each car.

Means for Solving the Problem

An elevator group supervisory control system according to the present invention is an elevator group supervisory control system that group-supervises a plurality of elevator units each having a car that can stop at a plurality of floors, the plurality of floors each being provided with: a hall registration device that places a plurality of car calls for moving the car to destination floors different from one another; and a display device that displays the car that has been assigned the plurality of car calls, the elevator group supervisory control system including: limit value setting means for setting, for each of the plurality of floors separately, a limit value for limiting a count of the plurality of car calls that can be assigned to the same car; count-up means for obtaining, when a new car call is made, a call count of the each car by a given method, based on information about the plurality of car calls that have been assigned to the car; and candidate car selecting means for comparing the limit value set to a floor where the new car call is made and the call count of the each car, to thereby select, as a candidate car, the car to which the new car call can be assigned from among the cars.

BEST MODE FOR CARRYING OUT THE INVENTION

A preferred embodiment of the present invention is described below with reference to the drawings.

First Embodiment

Figure 1:
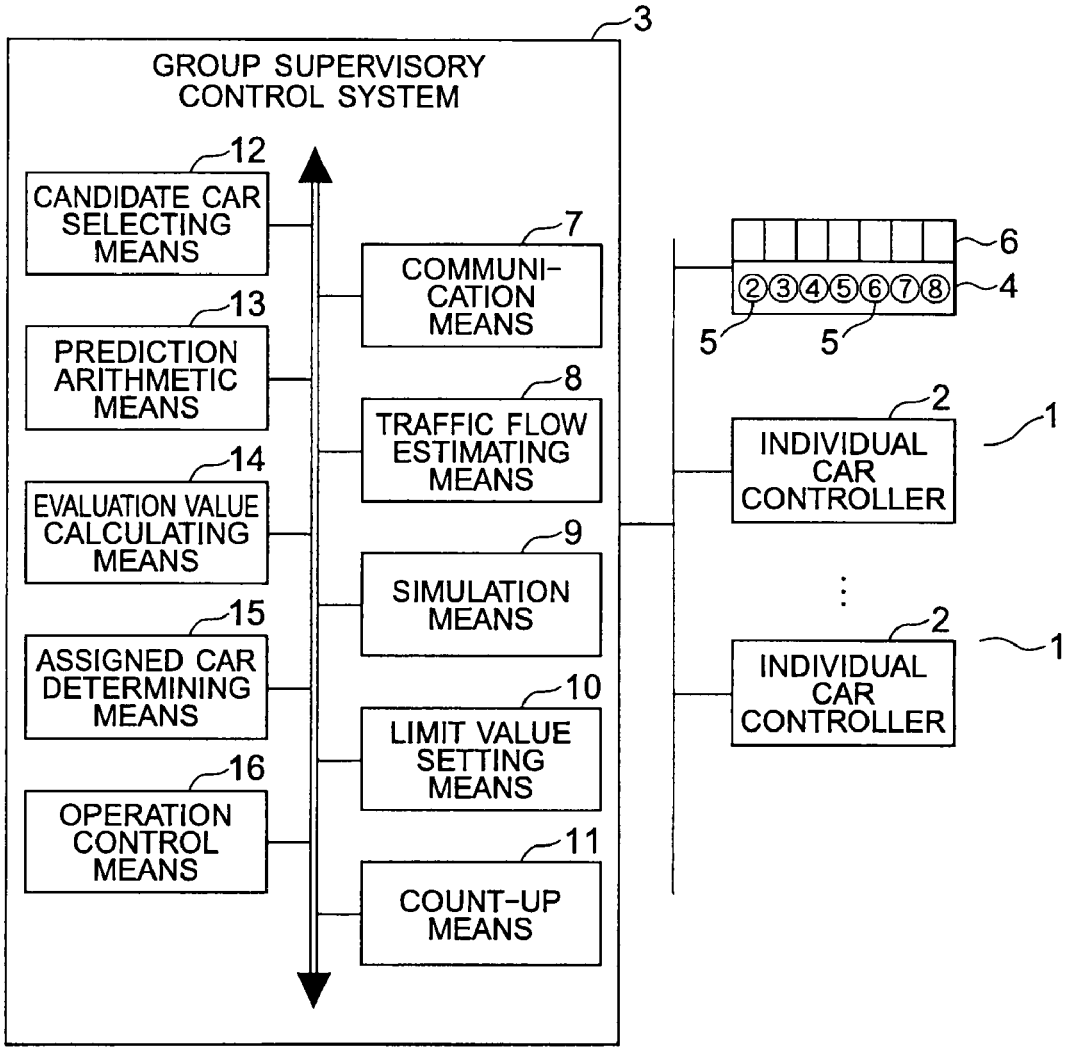
FIG. 1 A structural diagram illustrating an elevator group supervisory control system according to a first embodiment of the present invention.
Figure 2:
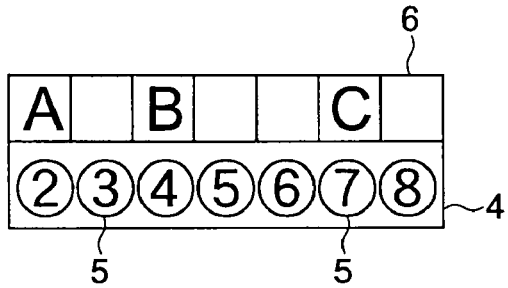
FIG. 2 An enlarged view illustrating a hall registration device and a display device in the group supervisory control system of FIG. 1.

FIG. 1 is a structural diagram illustrating an elevator group supervisory control system according to a first embodiment of the present invention. FIG. 2 is an enlarged view illustrating a hall registration device 4 and a display device 6 in the group supervisory control system of FIG. 1. In the drawings, a plurality of elevator units 1 are installed in a multi-story building. The elevator units 1 each have a car (not shown) which can stop at each floor and an individual car controller 2 for controlling the movement of the car. Control by the individual car controller 2 is supervised by a group supervisory control system 3, which is shared. In other words, the group supervisory control system 3 supervises the elevator units 1 as a group.

The hall registration device 4 is provided on each floor. The hall registration device 4 can selectively place a plurality of car calls for moving the car to destination floors different from one another. The hall registration device 4 has a plurality of hall operation buttons 5 for selecting a destination floor from among the floors. The hall operation buttons 5 are each marked to identify an individual destination floor. A car call is made by operating at least one of the hall operation buttons 5.

The hall registration device 4 is provided with the display device 6. The display device 6 displays a car that has already been assigned a car call. The car is displayed via an indicator by which the elevator unit 1 is identified. In FIG. 2, the car of Elevator A is assigned a car call that has the second floor as the destination, the car of Elevator B is assigned a car call that has the fourth floor as the destination, and the car of Elevator C is assigned a car call that has the seventh floor as the destination.

The group supervisory control system 3 includes communication means 7, traffic flow estimating means 8, simulation means 9, limit value setting means 10, count-up means 11, candidate car selecting means 12, prediction arithmetic means 13, evaluation value calculating means 14, assigned car determining means 15, and operation control means 16.

The communication means 7 performs information communication of the group supervisory control system 3 with the individual car controllers 2, the hall registration devices 4, and the display devices 6.

The traffic flow estimating means 8 estimates for each inter-floor travel pattern the amount of passenger transportation by a car at given time intervals (for example, for every five minutes). Specifically, the traffic flow estimating means 8 estimates an elevator traffic flow (parameter indicating how many passengers move from which floor to which floor) at given time intervals. The traffic flow estimation is made based on past learned data, changes with time in passenger transportation amount, and the like. As a traffic flow estimation method, a method that uses the total passenger count and the degree of congestion on a main floor, a method that uses a neural net technology, or the like has been conventionally known.

The simulation means 9 simulates car movement based on information from the traffic flow estimating means 8. In other words, the simulation means 9 performs a simulation in which a car is moved based on a traffic flow that is estimated by the traffic flow estimating means 8.

The limit value setting means 10 sets, to each floor, a limit value for limiting the count of car calls that can be assigned to the same car, based on information from the simulation means 9. This way, the same limit value is set to all cars on a common floor. Further, the count of car calls made on a common floor and assigned to the same car does not exceed a limit value that is set to this floor. A limit value set to a floor is determined separately for each direction in which a car leaving the floor can travel. Therefore, to the uppermost floor, a limit value is set only for the car lowering direction, to the lowermost floor, a limit value is set only for the car raising direction, and, to a floor between the uppermost floor and the lowermost floor, a limit value is set for each of the car raising direction and the car lowering direction, separately.

The count-up means 11 obtains the call count of each car when a new car call is made, based on information about car calls that have already been assigned to the car. Specifically, the count-up means 11 obtains for each car the count of normal stops (total call count) that the car will make if a new car call is to be assigned to the car, based on information about car calls that have already been assigned to the car. Of the obtained normal stop count, a count counted by a given method is obtained as the call count.

The candidate car selecting means 12 selects cars to which a new car call can be assigned as candidate cars based on information from the limit value setting means 10 and information from the count-up means 11. Specifically, the candidate car selecting means 12 compares a limit value set to a floor where a new car call is made and the call count for each car, to thereby select a car whose call count is equal to or lower than the limit value as a candidate car.

Based on a selection result by the candidate car selecting means 12, the prediction arithmetic means 13 performs a prediction calculation with respect to a parameter (for example, predicted time of arrival on the destination floor) related to the operation of the elevator units 1 that have candidate cars. The prediction calculation by the prediction arithmetic means 13 is performed by a known method for each of the cars for the case where the new car call is assigned to the car and for the case where the new car call is not assigned to the car, separately.

Based on a calculation result by the prediction arithmetic means 13, the evaluation value calculating means 14 performs a calculation for each candidate car with respect to a plurality of types of evaluation item. Examples of the evaluation items include the evaluation of a predicted call response waiting time and the evaluation of a predicted riding time to reach the destination floor.

Based on information from the evaluation value calculating means 14, the assigned car determining means 15 determines as an assigned car a candidate car that is evaluated comprehensively on the evaluation items as the best, and issues an assignment instruction for assigning the new car call to the determined assigned car.

The operation control means 16 controls the operation of each elevator unit 1 based on an assignment instruction from the assigned car determining means 15.

The group supervisory control system 3 is built from a computer that includes a computing unit (CPU), a memory unit (ROM, RAM, and the like), and a signal input/output unit. The functions of the communication means 7, the traffic flow estimating means 8, the simulation means 9, the limit value setting means 10, the count-up means 11, the candidate car selecting means 12, the prediction arithmetic means 13, the evaluation value calculating means 14, the assigned car determining means 15, and the operation control means 16 are implemented by the computer of the group supervisory control system 3. Specifically, the memory unit of the computer stores programs for implementing the functions of the communication means 7, the traffic flow estimating means 8, the simulation means 9, the limit value setting means 10, the count-up means 11, the candidate car selecting means 12, the prediction arithmetic means 13, the evaluation value calculating means 14, the assigned car determining means 15, and the operation control means 16. The computing unit executes computing relevant to the functions of the group supervisory control system 3 based on the programs stored in the memory unit.

Figure 3:
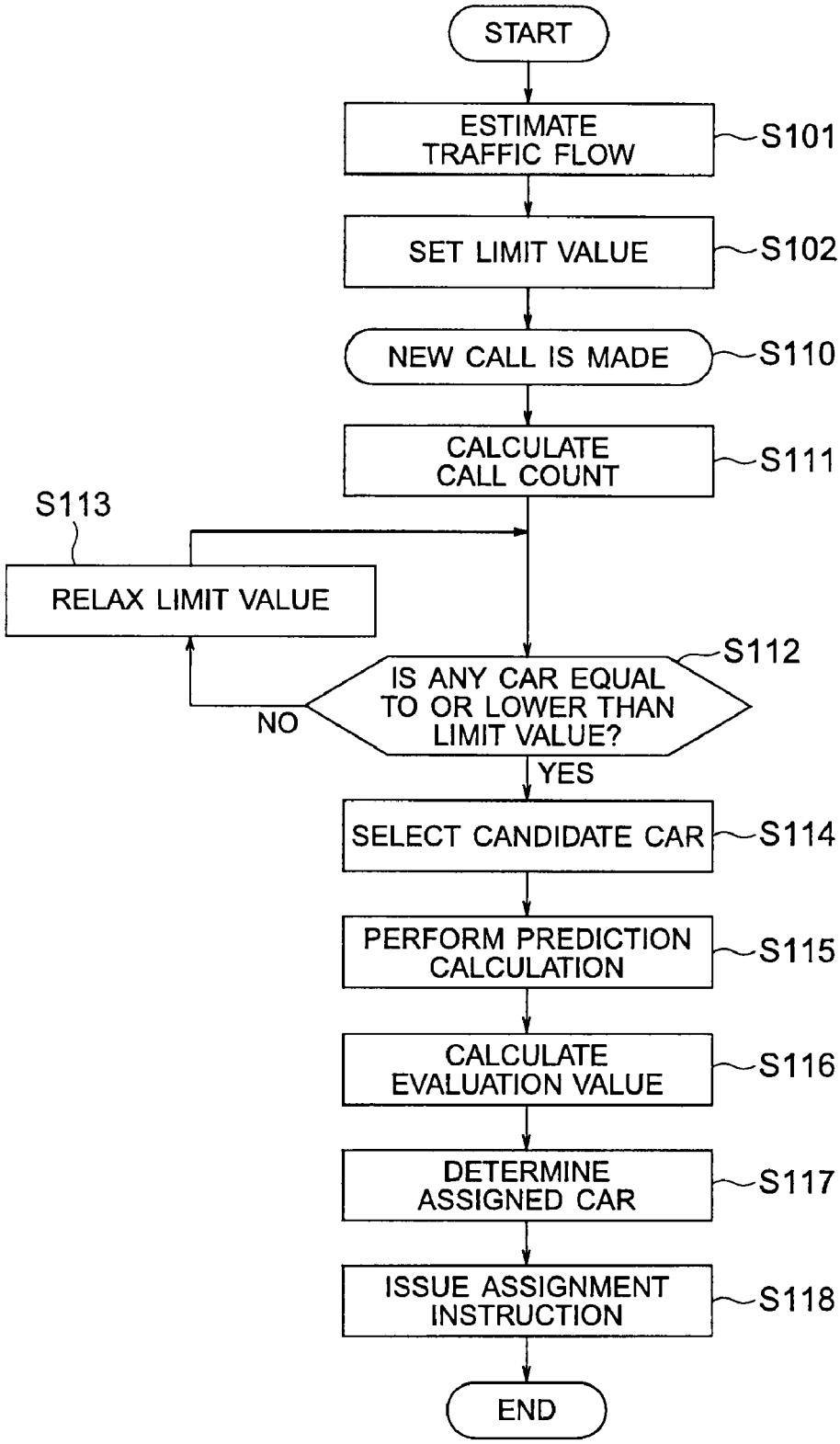
FIG. 3 A flow chart illustrating an operation of the group supervisory control system of FIG. 1.

The operation of the group supervisory control system 3 is described next. FIG. 3 is a flow chart illustrating the operation of the group supervisory control system 3 of FIG. 1. As illustrated in the drawing, in the group supervisory control system 3, a traffic flow estimation is made at given time intervals (for example, for every five minutes) by the traffic flow estimating means 8 (S101). Once the traffic flow is estimated, a limit value for limiting the count of car calls is set for each floor separately based on the estimated traffic flow. To the uppermost floor, a limit value for the car lowering direction alone is set, to the lowermost floor, a limit value for the car raising direction alone is set, and, to a floor between the uppermost floor and the lowermost floor, a limit value is set for each of the car raising direction and the car lowering direction, separately. The limit values are set by the limit value setting means 10 (S102).

When a new car call is made (S110), first, a total call count that a car will have if the new car call is to be assigned to the car is obtained for each car. The total call count is the number of times a car makes normal stops after the car leaves a floor where a new car call has been made. Thereafter, a call count is calculated from the total call count by a given method, which is described later. The call count is calculated by the count-up means 11 (S111).

Thereafter, the candidate car selecting means 12 compares a limit value set to the floor where the new car call has been made and the call count of each car. The candidate car selecting means 12 then determines whether or not a car whose call count is equal to or lower than the limit value is found among the cars (S112).

In the case where the call count of every car is higher than the limit value, the limit value is relaxed by raising the limit value to a higher numerical value (S113). Thereafter, the determination as to the presence/absence of a car whose call count is equal to or lower than the limit value (S112) and the limit value relaxation (S113) are repeated until a car whose call count is equal to or lower than the limit value is found.

When a car whose call count is equal to or lower than the limit value is found, the candidate car selecting means 12 picks every car whose call count is equal to or lower than the limit value as a candidate car (S114).

For every candidate car, a prediction calculation with respect to, for example, the predicted time of arrival on the destination floor is then performed by the prediction arithmetic means 13 (S115). The prediction calculation is performed for the case where the candidate car is assigned the new car call and for the case where the candidate car is not assigned the new car call, separately.

Thereafter, based on results of the prediction calculation for the candidate cars, the evaluation value calculating means 14 performs an evaluation value calculation with respect to various evaluation items (for example, evaluation of a predicted waiting time and evaluation of a predicted riding time) (S116).

A candidate car that comprehensively has the best evaluation values is then determined as an assigned car by the assigned car determining means 15 (S117). An instruction for assigning the determined assigned car is thus output from the group supervisory control system 3 (S118).

A method of setting a limit value is described next. Here, two types of setting method are described.

A first limit value setting method is a method in which each floor is classified as one of a busy floor and a general floor (non-busy floor), and a limit value Na is set to busy floors whereas a limit value Nb is set to general floors. Accordingly, the first setting method has only two numerical values Na and Nb as limit values set to the respective floors. In this example, whether a floor is a busy floor or a general floor is chosen based on a simulation result by the simulation means 9.

The choice between a busy floor and a general floor for each floor and numerical values set as limit values to busy floors and general floors may be determined in advance according to traffic patterns. For example, the first floor (lowermost floor) alone is determined as a busy floor during morning rush hours whereas all floors in other time zones than morning rush hours and any other floor than the first floor in morning rush hours are determined as general floors, and for example, the limit value Na=5 is set to the busy floor whereas the limit value Nb=8 is set to the general floors.

A second limit value setting method is a method in which a limit value is set to each floor separately according to the position of the floor in relation to the uppermost floor and in relation to the lowermost floor. For example, a limit value set to each floor for the car raising direction may be calculated by Expression (1) whereas a limit value set to each floor for the car lowering direction may be calculated by Expression (2).

$$\text{Limit value}=(\text{count of floors from the uppermost floor to the floor in question})/(\text{car count})\times Nc \quad (1)$$

$$\text{Limit value}=(\text{count of floors from the lowermost floor to the floor in question})/(\text{car count})\times Nd \quad (2)$$

Here, Nc denotes a coefficient for the raising direction and Nd denotes a coefficient for the lowering direction. The coefficients Nc and Nd may be determined based on simulation results by the simulation means 9, or may be determined in advance according to traffic patterns.

A method of calculating the call count (given method) is described next. Here, two types of calculation method are described.

A first call count calculation method is a method that bases the calculation on assignment information of each car with respect to only car calls placed from a floor where a new car call is made. For example, when the car of Elevator A is already assigned a car call that has been made on the fourth floor with the sixth floor as the destination, and is further assigned a new car call which is made on the common fourth floor with the seventh floor as the destination, the call count of the car of Elevator A is 2. In short, the call count of each car is obtained by only counting for each car how many car calls placed from a floor where a new car call is made are assigned to the car, even when there are car calls placed from other floors than the floor where the new car call is made.

Figure 4:
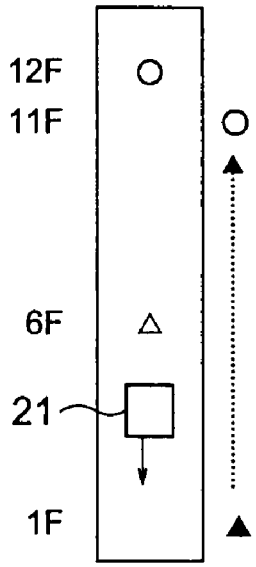
FIG. 4 A schematic diagram illustrating how a car moves when a new car call is made in an elevator unit of FIG. 1.

A second call count calculation method is a method in which the calculation is made by predicting how many times a car stops since the car leaves a floor where the new car call is made until the moving direction of the car is reversed. For example, as illustrated in FIG. 4, when a car 21 of Elevator A is already assigned a car call that has been made on the sixth floor with the twelfth floor as the destination, and is further assigned a new car call which is made on the first floor with the eleventh floor as the destination, the car 21 of Elevator A first travels to the first floor where the new car call is made and, after leaving the first floor until starting to reverse the moving direction, stops normally at three floors of the sixth floor, the eleventh floor, and the twelfth floor. The call count of the car of Elevator A is 3 in this case.

Which of the first and second calculation methods is to be chosen as the method of calculating the call count is determined according to the use or traffic of the building, for example.

In the thus structured elevator group supervisory control system 3, a limit value is set for each floor separately and, when a new car call is made, a call count is calculated for each car. Then, whether or not the new car call can be assigned is determined for each car by comparing a limit value set to a floor where the new car call is made and the call count of the car. Car call concentration in which many car calls are assigned to one common car can thus be prevented. Accordingly, the count of destination floors can be evened out among the cars, and the count of stops can be reduced for each car. This improves the overall operation efficiency of the elevator units 1.

In addition, a limit value is set for each floor separately by estimating the traffic flow in the building at given time intervals and simulating car movement based on the traffic flow. Therefore, a limit value suited to the time zone can be set, and the overall operation efficiency of the elevator units 1 is improved even more.

In addition, a call count is obtained based on assignment information of each car with respect to only car calls placed from a floor where a new car call is made. Passengers on the floor where the new car call is made can thus be dispersed among cars according to their destination floors. Therefore, even when the floor where the new car call is made is a busy floor, each car can avoid being packed to its full capacity. Moreover, because the count of stops is reduced for each car, the passenger riding time can be cut short.

In addition, a call count is calculated by predicting how many times a car stops since the car leaves a floor where a new car call is made until the moving direction of the car is reversed, and the operation efficiency at an up peak or a down peak can therefore be improved.

Figure 5:
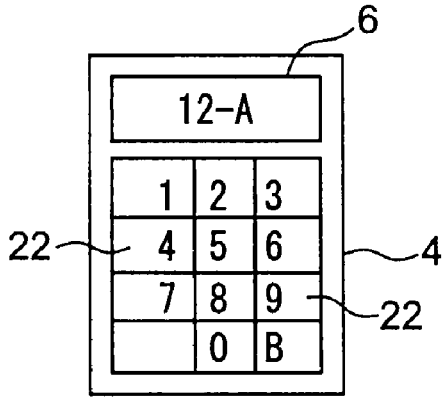
FIG. 5 An enlarged view illustrating another example of the hall registration device and the display device in the elevator group supervisory control system according to the first embodiment of the present invention.

In the example described above, each hall operation button 5 corresponds to a destination floor, and a car that has been assigned is displayed (display of the elevator unit 1) next to the hall operation button 5. Alternatively, the hall registration device 4 may be provided with a plurality of numerical keys 22 as illustrated in FIG. 5, and a car that has been assigned and a destination floor associated with this car are displayed together on the display device 6. In this case, the numerical keys 22 each display the number 0 or one of the numbers 1 to 9 or, if there is a basement, the symbol B (symbol indicating a basement). A car call is made by specifying a destination floor through the manipulation of the numerical keys 22.

The invention claimed is:

1. An elevator group supervisory control system that group supervises a plurality of elevator units each having a car that can stop at a plurality of floors, the plurality of floors each being provided with:

a hall registration device that places a plurality of car calls for moving the car to destination floors different from one another; and a display device that displays the car that has been assigned the plurality of car calls, the elevator group supervisory control system comprising:

limit value setting means for individually setting, for each of the plurality of floors, a limit value for limiting a count of the plurality of car calls that can be assigned to the same car;

count-up means for obtaining, when a new car call is made, a call count of the each car by a given method, based on information about the plurality of car calls that have been assigned to the car; and candidate car selecting means for comparing the limit value set to a floor where the new car call is made and the call count of the each car, to thereby select, as a candidate car, the car to which the new car call can be assigned from among the cars.

2. An elevator group supervisory control system according to claim 1, further comprising:

traffic flow estimating means for estimating, for each inter-floor travel pattern, an amount of passenger transportation by the car at given time intervals; and simulation means for performing a simulation about movement of the car based on information from the traffic flow estimating means, wherein the limit value setting means sets the limit value for the each of the plurality of floors separately based on information from the simulation means.

3. An elevator group supervisory control system according to claim 1, wherein the call count is obtained based on the information about the plurality of car calls that have been assigned to the car, the plurality of car calls being placed from only the floor where the new car call is made.

4. An elevator group supervisory control system according to claim 1, wherein the call count is obtained by predicting how many times the car stops since the car leaves the floor where the new car call is made until the car starts moving in an opposite direction, based on the information about the plurality of car calls that have been assigned to the car, the plurality of car calls being placed from the each of the plurality of floors separately.

5. An elevator group supervisory control system according to claim 2, wherein the call count is obtained based on the information about the plurality of car calls that have been assigned to the car, the plurality of car calls being placed from only the floor where the new car call is made.

6. An elevator group supervisory control system according to claim 2, wherein the call count is obtained by predicting how many times the car stops since the car leaves the floor where the new car call is made until the car starts moving in an opposite direction, based on the information about the plurality of car calls that have been assigned to the car, the plurality of car calls being placed from the each of the plurality of floors separately.

7. An elevator group supervisory control system according to claim 1, wherein traffic flow estimation is performed at given time intervals.

8. An elevator group supervisory control system according to claim 7, wherein the limit value for limiting the plurality of car calls is set based on the estimated traffic flow.

9. An elevator group supervisory control system according to claim 1, wherein the limit value set to a floor is determined separately for each direction in which a car leaving the floor can travel.

* * * * *